United States Patent [19]

Loranger

[11] 4,137,818

[45] Feb. 6, 1979

[54] UNITARY STRUCTURE TATTING SHUTTLE

[76] Inventor: Florene K. Loranger, 1512A-1 Gatehouse Cir. So., Colorado Springs, Colo. 80904

[21] Appl. No.: 817,098

[22] Filed: Jul. 19, 1977

[51] Int. Cl.[2] ..... D04C 7/00

[52] U.S. Cl. ..... 87/58; 242/50; 242/52

[58] Field of Search ..... 87/54, 58–62, 87/12; 242/50, 52, 61

[56] References Cited

U.S. PATENT DOCUMENTS

| | | | |
|---|---|---|---|
| 268,335 | 11/1882 | Wicke | 242/50 X |
| 405,077 | 6/1889 | Clark | 242/50 |
| 1,116,792 | 11/1914 | Buff | 87/58 |
| 1,173,102 | 2/1916 | Dill | 87/58 |
| 1,185,534 | 5/1916 | Preller | 87/58 |
| 1,314,209 | 8/1919 | Porter | 87/58 |
| 1,390,188 | 9/1921 | Barham | 87/58 |
| 1,769,953 | 7/1930 | Holland | 87/12 |
| 2,417,574 | 3/1947 | Themak | 242/50 X |
| 2,420,861 | 5/1947 | Carlson | 87/58 |
| 2,639,866 | 5/1953 | Bochan | 242/50 |
| 2,683,335 | 11/1882 | Wicke | 242/50 X |

FOREIGN PATENT DOCUMENTS

| | | | |
|---|---|---|---|
| 874,576 | 4/1953 | Fed. Rep. of Germany | 242/50 |

*Primary Examiner*—John Petrakes

*Attorney, Agent, or Firm*—Shanley, O'Neil and Baker

[57] ABSTRACT

A unitary tatting shuttle has an elongated body portion with laterally-extending thread guards at each end providing means for storage of a large quantity of thread wound around the periphery of the body. An axially-extending pin projecting from one end of the shuttle has a hook on its distal end for manipulating thread. A resilient sleeve can be telescopingly received on the thread supply wound on the shuttle to protect the thread against soil and to prevent windings of thread from being cast off the end of the shuttle during handling in the production of tatting.

6 Claims, 6 Drawing Figures

FIG. 1
PRIOR ART
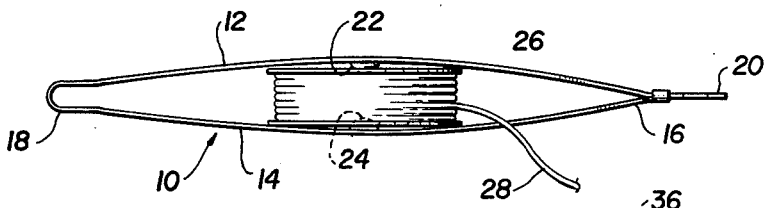
FIG. 2
PRIOR ART
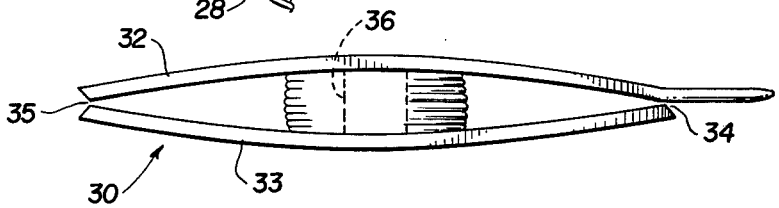
FIG. 3
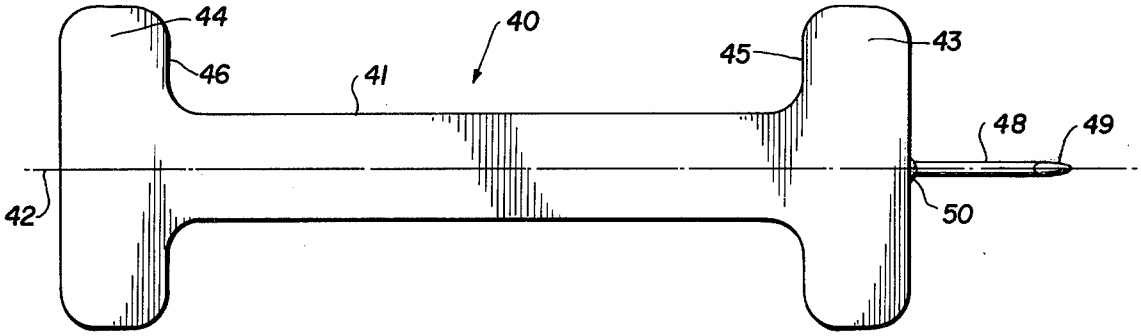
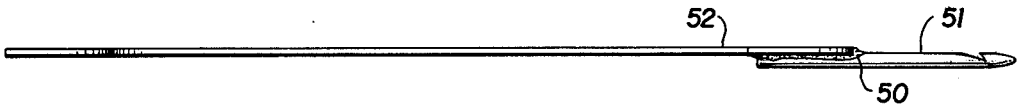
FIG. 4
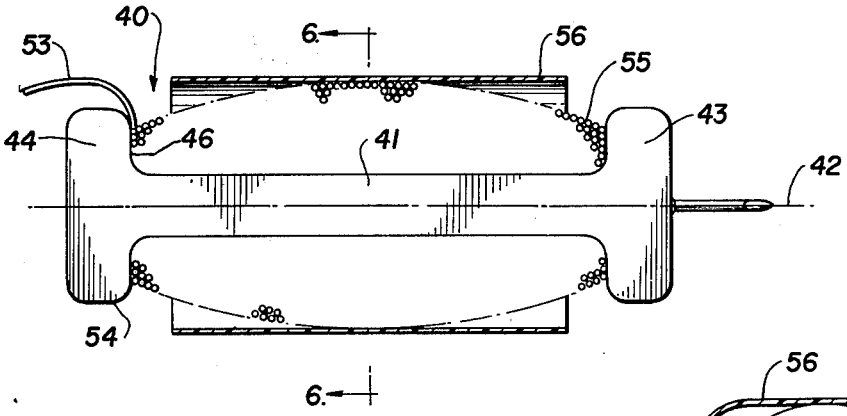
FIG. 5
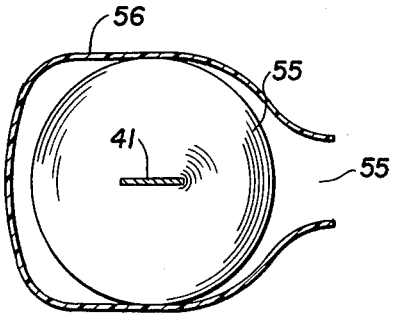
FIG. 6

UNITARY STRUCTURE TATTING SHUTTLE

The invention is concerned with an improved tatting shuttle; and more particularly with a single piece tatting shuttle construction having increased thread holding capacity over that previously available.

Tatting is handcraft needlework for making decorative edging for cloth materials, doilies, collar and cuff sets, and the like. Generally ring pattern designs are made from the thread and these are interconnected into floral and other decorative patterns. Examples of this artistic type of hand-crafted product, and prior art tatting shuttles, are shown and described in text publications such as "Macrame & Tatting", ©1973, Octopus Books Limited, 59 Grosvenor Street, London, England; "Tatting", ©1974, DMC Library, Editions Th. De Dillmont, France; and "Tatting: The Contemporary Art of Knitting with a Shuttle", ©1974, R. L. Auld, Van Nostrand Reinhold Co., New York, New York.

Commercially available tatting shuttles are manufactured from multiple pieces which define an internal cavity for carrying the thread within the working implement itself. These are shown and described in U.S. Pat. Nos. to Dill 1,173,102, Porter 1,314,209, and Preller 1,185,534. Other prior art disclosures of tatting shuttles, which apparently are not generally available commercially, include Barham U.S. Pat. Nos. 1,390,188, Carlson 2,420,861, and Buff 1,116,792.

All the prior art tatting shuttles suffer from the disadvantage of small thread capacity because the thread is held internally of the shuttle structure. The thread capacity is thus limited to and confined by the external periphery of the shuttle. This limits continuity since frequent refills are required. With the bobbin type, this requires removal of the bobbin, rewinding and replacement. With the centerpost type, separate longitudinal rewinding of the shuttle is required. Frequent knotting of the thread material is the result and this is disruptive of the artwork being crafted.

One of the major advantages and significant contributions of the present invention is a substantial increase in the thread-carrying capacity of the shuttle by providing for external storage of tatting thread without disruption of the tatting capabilities of the shuttle.

Other advantages and contributions of the present invention are brought out in the description of prior art shuttles and the shuttle structure of the present invention shown in the accompanying drawings.

In these drawings:

FIG. 1 is a side elevation view of a prior art shuttle using a removable bobbin carried internally of the shuttle peripheral structure;

FIG. 2 is a side elevation view of a prior art shuttle in which the thread is wound longitudinally on a central support internally of the shuttle peripheral structure;

FIG. 3 is a plan view of a tatting shuttle of the present invention;

FIG. 4 is a side elevation view of a tatting shuttle of the present invention;

FIG. 5 is a plan view, partially in cross-section, of the tatting shuttle with thread wrappings and a protective sheath for final wrapping portions of the tatting thread; and FIG. 6 is a cross-sectional view taken along the line 6—6 of FIG. 5.

Shuttle 10 of FIG. 1 represents the prior art type shown and described in more detail in U.S. Pat. No. 1,173,102 to Dill. Shuttle 10 comprises two outer walls 12, 14 which are generally formed from flat rolled sheet metal, bone, or plastic. These outer walls are spaced centrally and generally have a curvilinear configuration in both longitudinal and lateral cross-section. They are also tapered, in moving longitudinally from central portions toward pointed end portions 16 and 18. At such longitudinal ends, the outer walls 12, 14 are held together by welding, soldering or otherwise.

Longitudinal end 16 is the leading end of the shuttle and longitudinal end 18 is the trailing end during tatting operations. Shuttles of this type can include a needle-like extension 20 at the leading end of the shuttle or, if made from sheet metal, can include a hook.

Near the central portion of shuttle 10, protrusions 22 and 24, on the internal surface of walls 12 and 14, respectively, provide bobbin detents for removably holding a bobbin 26 within the space defined by the outer walls 12 and 14. Thread 28 is unwound from bobbin 26 during tatting operations.

One of the problems with the tatting shuttle of the type shown in FIG. 1 is maintaining sufficient frictional grip on bobbin 26 so as to keep it from slipping laterally from the defined cavity yet enabling it to rotate properly for unwinding of thread. In use, the hold on the bobbin can diminish so that the bobbin will slip too readily from the shuttle, or rotate too readily to feed thread faster than desired. Rewinding the excess thread onto the bobbin within the shuttle is generally a two-handed operation since the shuttle must be held with one hand and the bobbin turned with the other.

A significant drawback of the type of tatting shuttle shown in FIG. 1 is the minimal capacity of the bobbin. In general, the maximum overall length of this type of shuttle, exclusive of the needle, is about two and three-quarter inches, and the bobbin has a maximum diameter of about three-quarters of an inch with an internal core of about three-eighths of an inch. This provides limited capacity notwithstanding the small diameter or light gage threads used for fine tatting work, i.e., 70 to 100 gage thread. The tendency is to wind this bobbin too tight in order to crowd in more thread.

Preferably, a hand-crafted piece made by tatting should be made from and completed with a continuous thread, free of knots joining multiple pieces of thread. This has not been possible with the minimal capacity shuttle of the prior art especially when handcrafting a product such as a pillowcase, sheet, or tablecloth edging.

The prior art shuttle of FIG. 2 is shown and described in more detail in U.S. Pat. No. 1,185,534 to Preller. However, briefly, this shuttle 30 includes two exterior blades 32 and 33, which are open at longitudinal ends 34 and 35. These blades are held together centrally by a center post structure 36. Tatting thread is wound longitudinally on the center post by feeding it between the openings 34 and 35 and winding in a longitudinal direction.

Shuttle 30, which has approximately the same overall dimensions as shuttle 10 of FIG. 1, is limited to internal winding of thread and therefore has a relatively small thread holding capacity.

Also, there are certain other disadvantages in usage of this shuttle, such as the winding on of thread which must be fitted between the longitudinal end openings. Actually, aspects of the winding-on of thread are in conflict with those of unwinding. During tatting, it is desired that the longitudinal ends exert a certain contact pressure on the thread, while for winding-on, it is preferred that the ends be open. Further, unwinding with either of these prior art shuttles is not handy or convenient since unwinding takes a deliberate interrupting step in the tatting operations. For example, for unwinding purposes, the entire shuttle 30 of FIG. 2 must be turned longitudinally end-over-end. In the shuttle of FIG. 1, the bobbin must be rotated — interrupting tatting. Both shuttles present the problem of proper tightness for thread control.

By contrast to the shuttles of FIGS. 1 and 2, tatting shuttle 40 of FIG. 3 provides a large thread holding capacity and is of a structure and configuration so as not to be limited by interior space availability. Shuttle 40 can be easily wound, and unwinding of the thread from the shuttle involves a movement which flows with and is a part of the tatting operation; interruption for unwinding is not required.

Referring to FIG. 3, shuttle 40 includes an elongated core portion 41 extending in substantially parallel relationship to the longitudinal axis 42. Thread guard means 43 is located at the leading longitudinal end of the shuttle and thread guard means 44 is located at the trailing longitudinal end of the shuttle. Thread guard means 43 and 44 include, on their longitudinal interior portions facing the core 41, thread barrier means 45 and 46.

The thread guard configuration, at each longitudinal end, has a lateral dimension measured transversely of the longitudinal axis 42 which is substantially greater than the lateral dimension of the core 41. The ratio of these dimensions is at least 2 to 1 and preferably about 3 to 1. For example, in one embodiment of the invention, the overall length of the core and the two thread guards of the shuttle can be approximately four and one-half inches with the longitudinal length of the elongated core 41 being approximately three and one-half inches. In this embodiment, the lateral dimension of the core 41 would be approximately one-half inch while the lateral dimension of the leading and trailing end thread guard means 43 and 44 would be at least one inch and preferably about one and one-half inch. This arrangement provides for high capacity storage of thread, including heavy gage thread such as 30 gage and heavier, such as the knit-type crocheting threads that can be bulkier and heavier than the gage size 10. While the dimensions of the various components can vary, the core preferably has a length which is at least about three-quarters of the combined length of the core and thread guard means.

The shuttle 40 is a single piece of material, unitary in structure, and can be planar in configuration as shown in the embodiment of FIG. 4. For example, this tatting shuttle can be made from flat rolled sheet metal such as corrosion protected steel or aluminum; it can also be formed from bone, plastic and other materials.

At the leading end 43 of shuttle 40, pin means 48 extends along the longitudinal axis beyond the main body portion of the shuttle. Such pin means provides for an additional feature of the invention useful in joining together picots into a particular pattern. Hook means 49, which should have a pointed, yet rounded, configuration to provide a smooth contour for purposes of forming a loop without snagging the thread, are disposed at the longitudinal extremity of the pin means 43. The pin means and hook means can be part of the unitary structure of shuttle 40 or they can be added by welding, soldering, or otherwise joining as at 50 in the embodiment of FIG. 4 in which a pin means 50 is made integral with shuttle body 52. In the joining of picots or rings, the thread is pulled through a picot or ring from a loop. The shuttle is passed through the loop and the thread is pulled taut.

The barrier edge means 45 and 46 of shuttle 40 should define an interior angle of approximately 90° with longitudinal axis 42 so that internal wrappings of the thread means are more positively held on the core means as external wrappings of thread are removed over trailing end 44 and worked between the two ends of the shuttle with the hands and fingers. The lateral extremities of the thread guard means are rounded and smooth in contour to prevent catching or splitting of thread. Heavy plastic is a preferred material to facilitate provision of these contours. The straight edge type barriers confronting the core also facilitate winding-on in that thread can be wound and built up in a sequential fashion which aids in uniform and controlled unwinding.

As shown in FIG. 5, the shuttle 40 is wound with heavy "knit-cro-sheen" thread which would be comparable to about a No. 1 gage thread in size. The tatting shuttle of the dimensions described above with approximately a three and one-half inch core can readily hold 175 yards of such heavy thread; as standardly distributed, this comprises a full ball of such thread. The purpose of the barrier edges, particularly trailing end barrier edge 46, in having approximately a 90° relationship to the longitudinal axis 42, is to prevent pulling off outer wraps of thread windings as thread 43 is unwound from the hand-held shuttle.

Barrier edge 46 is especially important since the working thread is ordinarily moved over the trailing end of the shuttle after start of the tatting operation. The objective is to prevent, in a positive manner, inner thread wrappings from unwinding but not create any substantial impediment to removal of working thread 53 as it is unwound over the trailing end 44. Therefore, lateral ends of the thread guard means, such as 54, should be rounded since the working thread unwinds over the trailing end in a circular or unspooling type of action; such thread should move smoothly over edges such as 54. When a full ball of thread is wound on the shuttle, the invention teaches the use of means to protect the thread and prevent undesired unravelling due to handling.

Also shown in longitudinal cross-section in FIG. 5, sheath 56 can be utilized to provide such protection for outer windings when a high volume of thread, as shown in this Figure, is wound on shuttle 40.

The configuration of this sheath can be better visualized from FIG. 6 which is a cross-sectional view of FIG. 5 taken along lines 5—5. As shown by this cross-sectional view, tatting thread is wound on core 41 forming a body 55 of stored thread. Sheath 56 has a generally "U" shaped configuration in cross-section and, in one embodiment, is formed of material having spring-like properties so it can be readily spread at its open end 58 to fit over stored thread 55. Sheath 56 can be of various sizes or of various spring materials so that it does not grip stored thread 55 too tightly so as to impede unwinding of thread 53.

The main purpose of sheath 56 is to protect the thread when large capacities have been wound on core 41 since the shuttle 40, with stored thread, is manipulated by hand, generally with contact of the full palm of the user's hand. Such protection prevents soiling of the thread. Further, when the thread is wrapped on the core 41 in a random manner, use of sheath 56 helps prevent accidentally pulling off thread windings near the trailing end while not impeding unwinding of thread windings in turn. The sheath can also take the form of stretchable cloth material in the shape of a tube or cylinder which fits over the full ball of stored thread.

Various materials can be used to form the shuttle: sheet metal, plastic, bone, and other materials generally used in making shuttles. The size of the shuttle can vary without deviating from the present teachings but, in general, dimensions as described above provide an easily-used, hand-held shuttle better adapted to heavy thread uses than the small shuttles of the prior art which must be manipulated with the fingers. Various changes in the overall appearance and configuration, e.g., thickness of the shuttle, can be resorted to without departing from the basic teachings of the invention which provide for unwinding of the thread during the natural movements of the shuttle through and about extensions of the thread as held by the fingers during tatting. Therefore, the scope of the present invention should be determined from the appended claims.

I claim:

1. Handcraft tatting shuttle comprising an elongated core having a longitudinal axis, leading end, and trailing end, leading and thread guard means of greater lateral dimension than the lateral dimension of such core, trailing end thread guard means having a greater lateral dimension than the core, such core being unitary with such leading and trailing end thread guard means, such core, in combination with such leading and trailing end thread guard means, providing a laterally-open, spool-like space for receiving and holding tatting thread wrapped laterally in angled relationship to the longitudinal axis of the elongated core, and pin means integral with and extending longitudinally from the leading end of the tatting shuttle along the longitudinal axis of the elongated core, and a hook means located at the longitudinal end of the pin means removed from the leading end of the tatting shuttle.

2. The tatting shuttle of claim 1 in which the ratio of the lateral dimension of such leading and trailing end thread guard means to the lateral dimension of such elongated core is about 3:1.

3. The tatting shuttle of claim 1 in which the leading and trailing end thread guard means present barrier edge means disposed inwardly of longitudinal ends of the tatting shuttle confronting the elongated core, such barrier edge means being in angled relationship to the longitudinal axis of the core so as to define with such longitudinal axis an interior angle which is about 90°.

4. The tatting shuttle of claim 1 having an overall length of about four inches, each such thread guard means on longitudinal ends of the elongated core extending laterally a total of about one inch, and such core having a lateral dimension which is no more than about half the lateral dimension of such thread guard means and a longitudinal dimension which is at least about three-quarters of the overall length of the combined core and thread guard means.

5. In combination with the tatting shuttle of claim 1 when wound with thread wrappings in angled relationship to the longitudinal axis of the shuttle forming a spool of thread extending longitudinally along such core and laterally approximately the dimension of such thread guard means, an elongated sheath having a longitudinal dimension approaching but less than that of the elongated core for covering a major portion of exterior thread windings of such spool.

6. The combination of claim 5 in which the elongated sheath comprises semi-rigid material, such sheath being open at its longitudinal ends and having a generally "U" shaped lateral cross-section so as to be openable along its longitudinal side, such sheath having spring action to provide for clamping over thread wrappings held on the tatting shuttle while permitting unwinding of thread over the trailing end thread guard means of the tatting shuttle.

* * * * *